US009191729B2

(12) United States Patent
Lin

(10) Patent No.: US 9,191,729 B2
(45) Date of Patent: Nov. 17, 2015

(54) EARPHONE WITH ADJUSTABLE-LENGTH CABLE

(71) Applicant: Chun-Hsuan Lin, New Taipei (TW)

(72) Inventor: Chun-Hsuan Lin, New Taipei (TW)

( * ) Notice: Subject to any disclaimer, the term of this patent is extended or adjusted under 35 U.S.C. 154(b) by 0 days.

(21) Appl. No.: 14/274,715

(22) Filed: May 10, 2014

(65) Prior Publication Data

US 2015/0215694 A1 Jul. 30, 2015

(30) Foreign Application Priority Data

Jan. 29, 2014 (TW) ..... 103202028 U

(51) Int. Cl.
*H04R 1/10* (2006.01)

(52) U.S. Cl.
CPC ..... *H04R 1/1033* (2013.01)

(58) Field of Classification Search
CPC .... H04R 1/10; H04R 2205/022; H04R 1/105; H04R 5/0335; H04R 2201/10
USPC ..... 381/370, 374, 384
See application file for complete search history.

(56) References Cited

U.S. PATENT DOCUMENTS

| | | | | |
|---|---|---|---|---|
| 7,382,891 | B2 * | 6/2008 | Weikel et al. | 381/384 |
| 8,831,267 | B2 * | 9/2014 | Annacone | 381/384 |
| 2011/0235844 | A1 * | 9/2011 | Yoshino | 381/384 |
| 2013/0177195 | A1 * | 7/2013 | Sze et al. | 381/384 |

* cited by examiner

*Primary Examiner* — Suhan Ni
(74) *Attorney, Agent, or Firm* — Li & Cai Intellectual Property (USA) Office

(57) ABSTRACT

An earphone with adjustable-length cable includes a plugging section, a connecting cable and a receiving section. The plugging section has an attach-conductive adapter and a plug at two ends respectively. The connecting cable connects the plugging section and the receiving section, and has at least one separable attaching cable. The separable attaching cable has two attach-conductive adapters at two ends respectively. The receiving section has an attach-conductive adapter and an audio-playing unit at two ends respectively. Each attach-conductive adapter is formed with an end surface, and has at least one attaching element and a plurality of conductive plates exposed at outside of the end surface. The attach-conductive adapters are attached each other by the attaching elements, and electrically connected to each other through the conductive plates, so that signals from the plugging section are transmitted to the receiving section and are played by the audio-playing unit.

12 Claims, 9 Drawing Sheets

EARPHONE WITH ADJUSTABLE-LENGTH CABLE

BACKGROUND OF THE INSTANT DISCLOSURE

1. Field of the Instant Disclosure

The instant disclosure relates to an earphone with adjustable-length cable, especially to a sectional wired earphone includes a plug, an audio-playing unit and a connecting cable arranged between the plug and the audio-playing unit, which are attractively connected in sectional and separable manner.

2. Description of Related Art

Since earphone was invented, it has become the most popular auxiliary tool for enjoying music. Because wireless earphone needs battery with expansive price, wired earphone is still commonly used. The wired earphone has a plug for plugging into an electronic device of audio-player to receive audio, an audio-playing unit for transferring signals to voice, and a connecting cord connecting the plug and the audio-playing unit.

The audio-playing unit is usually worn in user's ear, and receiving audio signals from the electronic device by the connecting cord and the plug. Recently, many kinds of portable electronic device are used very popularly. Especially smart phone includes the features of voice communication and media player . . . etc., which almost has become one of the must-have appurtenances, no matter outdoor recreation or sport. User usually operates a portable electronic device with an earphone, so that hands are available to do something.

When user is listening audio or music, the wired earphone connected to the portable electronic device is easy to be inattentively pulled and dragged, especially during walking. After the earphone is dragged, the plug of earphone may be separated from the electronic device. In extreme situation, the electronic device may be pulled and dropped accidentally.

On the other hand, the length of wired earphone is fixed and usually reserved an additional length. To adjust the redundant length of the connecting cord of earphone, one common method is to provide a winding device. Such method not only additional equipment is needed, but also the accidental dragging of the above-mentioned problem is still unavoidable.

SUMMARY OF THE INSTANT DISCLOSURE

The object of the instant disclosure is to provide an earphone with adjustable-length cable, which divides a plug, an audio-playing unit and a connecting cord disposed between the plug and the audio-playing unit in segmental manner and separable manner for adjusting the length the cable and avoiding the electronic playing device from being dropped unintentionally.

In order to achieve the aforementioned objects, according to an embodiment of the instant disclosure, an earphone with adjustable-length cable, includes a plugging section, a connecting cable and a receiving section. The plugging section has a attach-conductive adapter at one end thereof, and a plug at the other end thereof. The receiving section has an attach-conductive adapter at one end thereof, and an audio-playing unit at the other end thereof. The connecting cable is connected between the plugging section and the receiving section. The connecting cable includes at least one separable attaching cable, and two ends of the separable attaching cable have a attach-conductive adapter, respectively. Each attach-conductive adapter is formed with an end surface, and has at least one attaching element and a plurality of conductive plates exposed outside the end surface. The attach-conductive adapter of the plugging section, the attach-conductive adapter of the receiving section and the attach-conductive adapter of the connecting cable are attached each other through the at least one attaching element, and electrically connecting each other through the conductive plates. Therefore, signals from the plugging section are transmitted to the receiving section and transferring to voice so as to play by the audio-playing unit.

Based on the above, the instant disclosure has at least the following advantages, that the connecting cable of the earphone is segmental and separably attracted to each other. Therefore, the length of the connecting cable is adjustable, and the many separated sections can be stacked without entangling and tying. A convenient collation manner is provided. Besides, the separable attaching manner allows the earphone is separated from the electronic device without pulling down. A safety protective method is provided.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
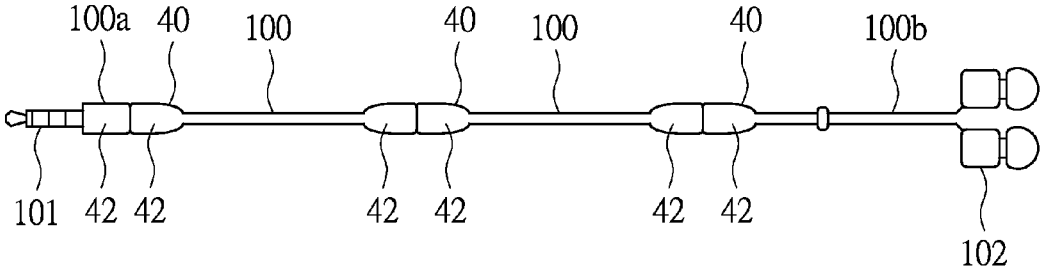
FIG. 1 shows a assembled view of an earphone with adjustable-length cable according to one embodiment of the instant disclosure.

Please refer to FIG. 1, which is a front view of an earphone with adjustable-length cable according to one embodiment of the instant disclosure. In this embodiment, the earphone with adjustable-length cable includes a plugging section 100*a*, a connecting cable and a receiving section 100*b*. One end of the plugging section 100*a* has an attach-conductive adapter 42, and the other end has a plug 101. The connecting cable is arranged between the plugging section 100*a* and the receiving section 100*b*. One characteristic of the instant disclosure is that the connecting cable having at least one separable attaching cable 100. Each separable attaching cable 100 has a protective jacket 40 as an outer layer thereof, and two ends having an attach-conductive adapter 42 respectively. One end of the receiving section 100*b* has a attach-conductive adapter 42, and the other end has an audio-playing unit 102.

The separable attaching cable 100 of this embodiment has characteristics of being able to separate from another one. First, the length is adjustable to store up easily. Secondly, the connecting cable, the plugging section 100*a* and the receiving section 100*b* can be separated temporarily. When the earphone has suffered an external force, it can be broken into several sections to avoid the electronic playing device from being tugged and dropped. The term of "separable attaching" means it can be separated many time and attached to each other again, including magnetic attraction, or mechanical attachment, such as magnet, fastener (such as Velcro attachment), buckle element, or wedged element . . . etc., but not limited thereto.

Figure 2:
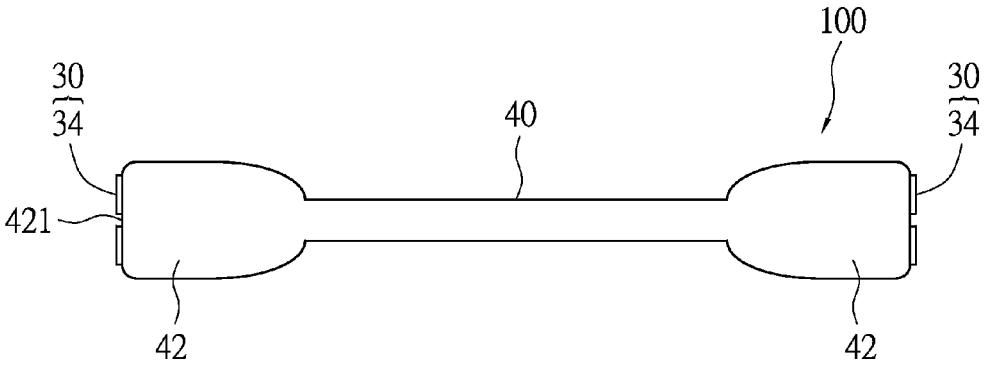
FIG. 2 shows a front view of a separable attaching cable according to one embodiment of the instant disclosure.
Figure 2A:
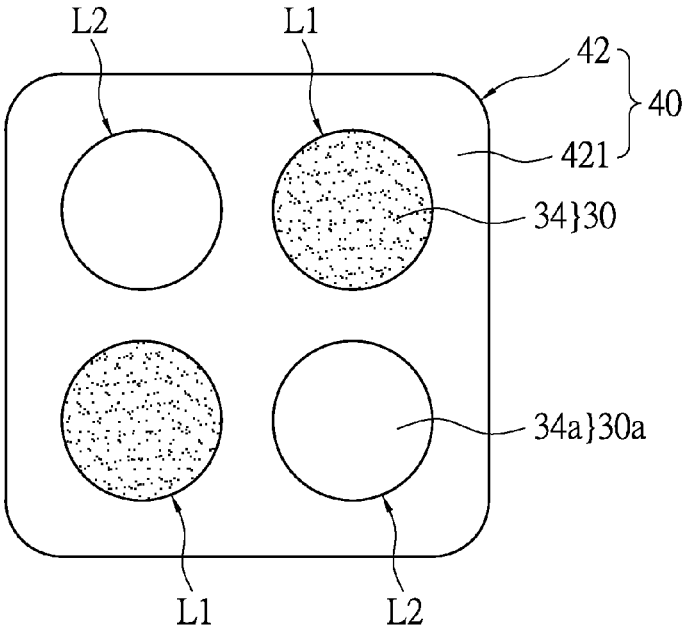
FIG. 2A is a left side view of FIG. 2.
Figure 2B:
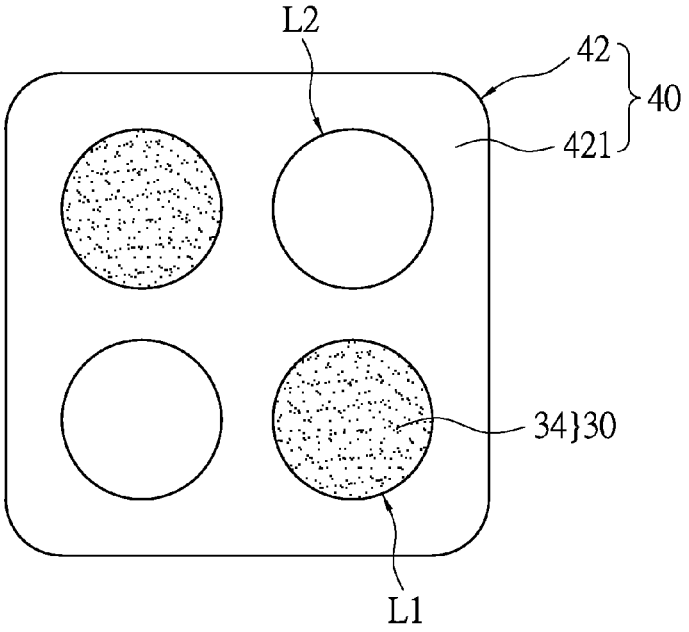
FIG. 2B is a right side view of FIG. 2.

Please refer to FIG. 2, which is a front view of the separable attaching cable of the instant disclosure. FIG. 2A and FIG. 2B are left and right sides views of FIG. 2. In this embodiment, the separable attaching cable 100 has a pair of magnetic conducting units L1 and a pair of nonmagnetic conducting units L2, which are covered by the protective jacket 40. The magnetic conducting units L1 and the nonmagnetic conducting units L2 are arranged in diagonal manner. The number of magnetic conducting units L1 shown in the figures is just one embodiment according to the instant disclosure, and is not limited thereto. Its number can be at least one.

Please refer to FIG. 2A and FIG. 2B, which show one embodiment of the attach-conductive adapter. Each of the attach-conductive adapters 42 has an end surface 421, a plurality of conductive plates 34 exposed outside the end surface 421, and at least one attaching element arranged behind the element 34 as shown in the FIG. 3 and FIG. 3A. The attaching element is fixed in the attach-conductive adapter 42. For this embodiment, the attaching element is given an example as a magnetic member 20, but not limited thereto. The attach-conductive adapters 42 are attached to each other by the at least one magnetic member 20, and electrically connected to each other by the conductive plates 34 for transmitting signal from the plugging section 100*a* to the receiving section 100*b*, finally, transferring into voice played by the audio-playing unit 102.

One feature of the instant disclosure is that the magnetic conducting unit L1 provides both functions of magnetic attraction and electrical conduction. The function of magnetic attraction does not occupy additional area to save space. Thus, this embodiment can be adapted as video transmission cable or other cable with smaller diameter. Further, this embodiment arranges the pair of magnetic conducting units L1 and the pair of nonmagnetic conducting units L2 in crisscross manner, so that it can attach with another identical separable attaching cable 100 stably to each other, as shown in FIG. 1.

Figure 3:
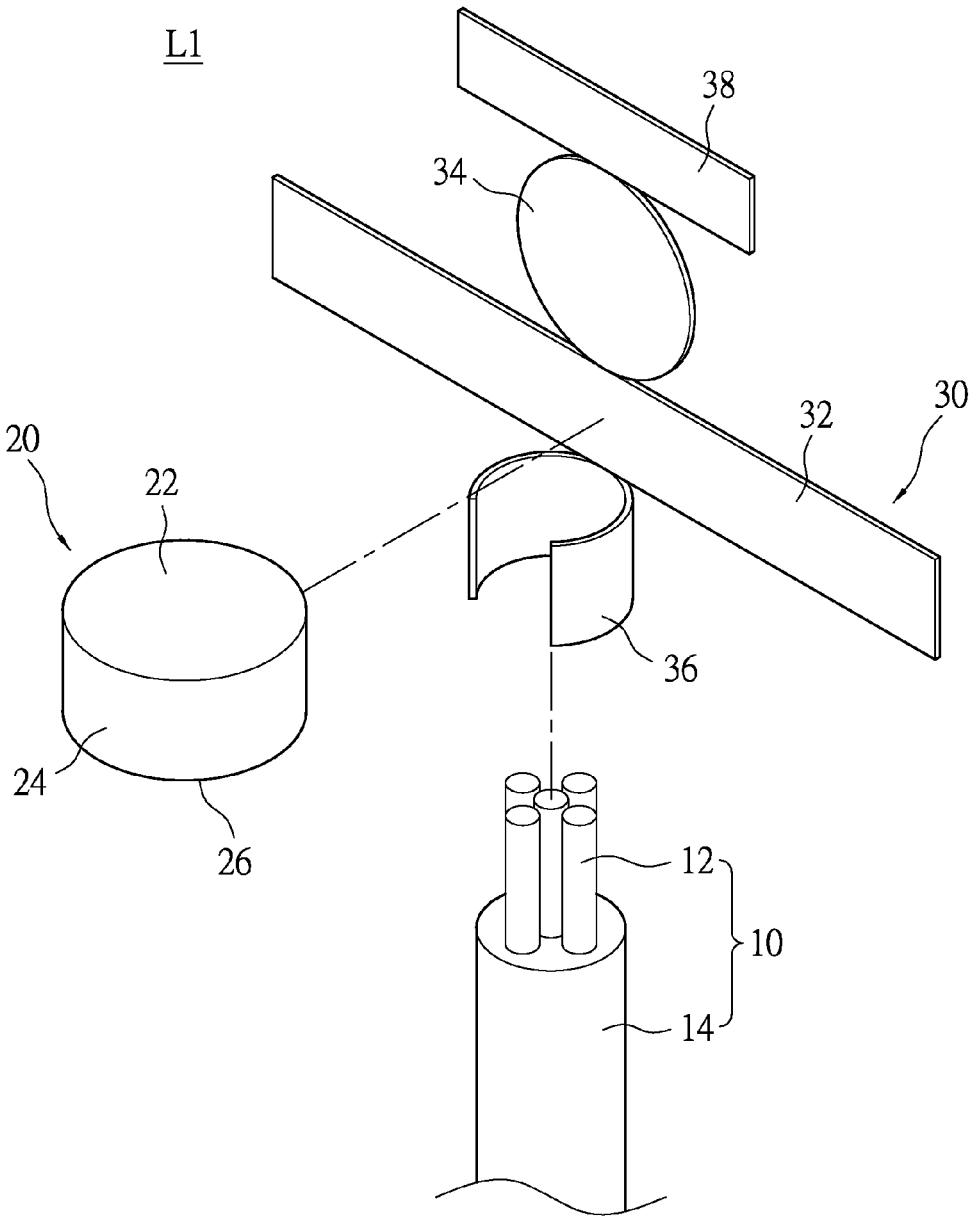
FIG. 3 shows a perspective exploded view of a magnetic conducting unit according to the instant disclosure.
Figure 3A:
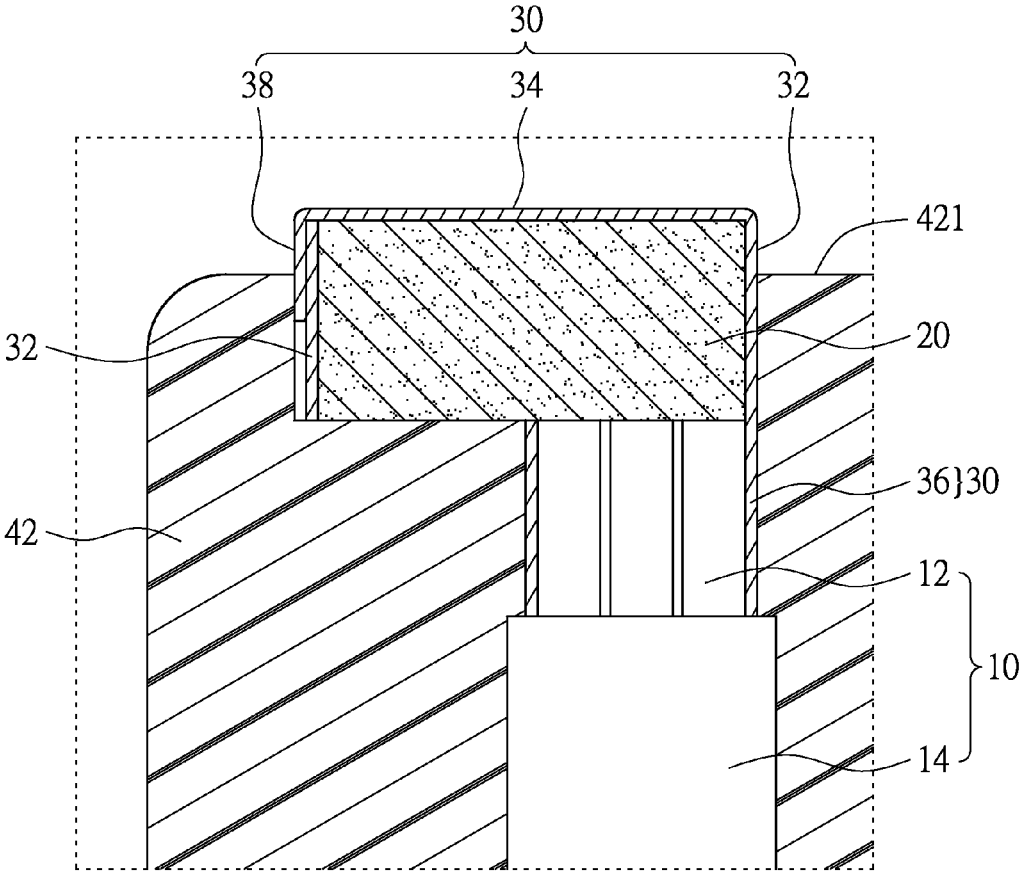
FIG. 3A shows a cross-sectional view of the magnetic conducting unit according to the instant disclosure.

Please refer to FIG. 3, which is a perspective view of the magnetic conducting unit according to the instant disclosure. The detail structure of magnetic conducting unit L1 is described as followed to illustrate how it provides both functions of magnetic attraction and electricity conduction.

The magnetic conducting unit L1 has a cord 10, a magnetic member 20, and an adapting terminal 30. The cord 10 has a conductive wire 12, and an insulative layer 14 covering the conductive wire 12. There are many conductive wires 12 shown in FIG. 3, but the number is not limited thereto.

The magnetic member 20 is disposed at a front end of the cord 10, and a column-shaped magnet is given as an example. It can be an available power magnet, such as a NdFeB magnet of 2 mm in diameter and 1 mm in thickness, but not limited thereto. The column-shaped magnetic member 20 has an outer surface 22, a side surface 24 contiguous the outer surface 22, and a bottom surface 26.

The adapting terminal 30 is made of conductive material, such as copper, which includes a holding part 32 to retain the magnetic member 20, a conductive plate 34 connecting with the holding part 32, and an extending part 36 fixedly connected with the conductive wire 12. In this embodiment, the holding part 32 holds the side surface 24 of the magnetic member 20. The conductive plate 34 is mainly functioned as electricity conduction. The extending part 36 is used to connect the conductive wire 12 of the cord 10, and the connecting way can be clipping or soldering, but not limited thereto. The extending part 36 of this embodiment is surrounded and clipped to fixedly connect the conductive wire 12 of the cord 10.

In this embodiment, the conductive plate 34 and the extending part 36 are oppositely arranged at two sides of the holding part 32. The conductive plate 34 covers the outer surface 22 of the magnetic member 20, which not only allows the magnetic force of the magnetic member 20 to pass through to attract another separable attaching cable 100, but also provides function of electricity transmission. The length of the holding part 32 can be substantially equal to the length of the side surface of the magnetic member 20 for covering the magnetic member 20. However, it could cove not fully.

The protective jacket 40 is made of insulative material, which covers the cord 12. Two ends of the separable attaching cable 100 are equipped with one attach-conductive adapter 42, respectively. Each attach-conductive adapter 42 is formed with the end surface 421 facing outside. The conductive plate 34 of the adapting terminal 30 is exposed outside the end surface 421. The conductive plate 34 can be slightly protruded outside the end surface 421, so that it is conveniently contact with the conductive plate 34 of another attach-conductive adapter 42.

The adapting terminal 30 of this embodiment further has a snapping part 38 connecting with the conductive plate 34. The snapping part 38 and the holding part 36 are oppositely arranged at two sides of the conductive plate 34 and covers at a periphery of the magnetic member 20. Please refer to FIG. 3A, which is a cross-sectional view of the magnetic conducting unit L1 of this embodiment. In detail, the snapping part 38 can increase the stability of the conductive plate 34 to avoid the conductive plate 34 from being turned outward. The snapping part 38 could be further formed with a structure for stably connected with the protective jacket 40, such as hook or saw-toothed structure.

Figure 4:
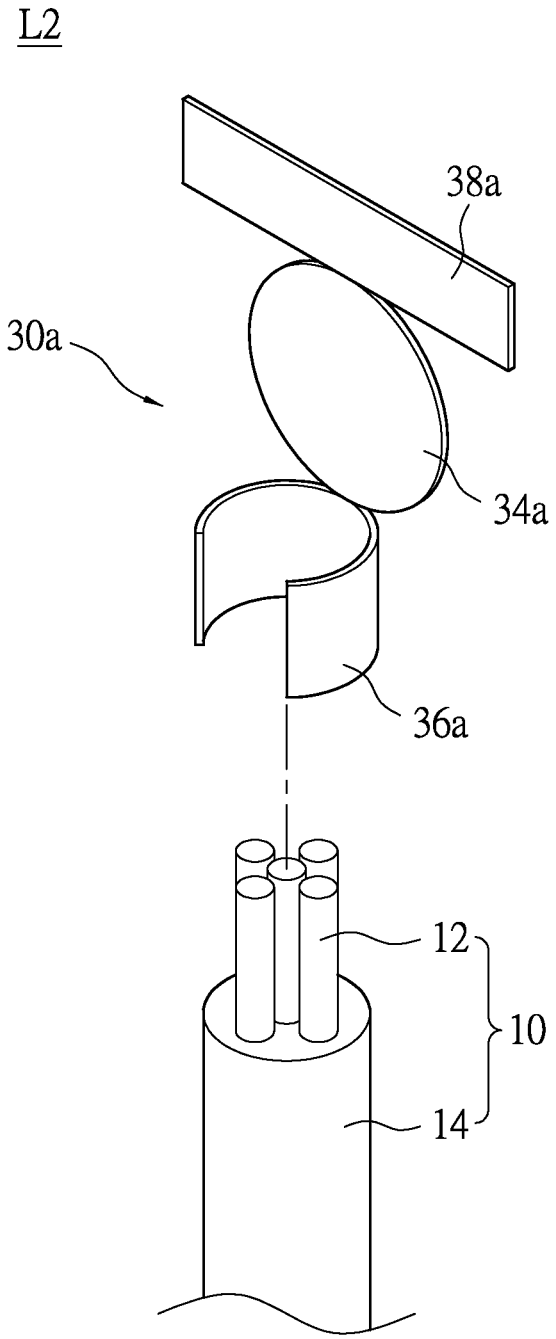
FIG. 4 shows a perspective exploded view of a nonmagnetic conducting unit according to the instant disclosure.

By the instant disclosure, the magnetic member 20 is hidden in the magnetic conducting unit L1 of the separable attaching cable 100. Further, the separable attaching cable 100 has a nonmagnetic conducting unit L2 which is covered in the protective jacket 40, as shown in FIG. 2A and FIG. 2B, so that the separable attaching cable 100 has identical contacting end. Please refer to FIG. 4, the nonmagnetic conducting unit L2 includes a cord 10 and a non-attaching adapting terminal 30*a*. The cord 10 has a conductive wire 12, and an insulative layer 14 covering the conductive wire 12. The non-attaching adapting terminal 30*a* has an extending part 36*a* connected with the conductive wire 12, and a conductive plate 34*a* connected with the extending part 36*a*, and a snapping part 38*a* connected with the conductive plate 34*a*. The snapping part 38*a* and the extending part 36*a* are oppositely arranged at two sides of the conductive plate 34*a*, the conductive plate 34*a* is exposed at outside of the end surface 421 (as shown in FIG. 2A).

In this embodiment, the number of the magnetic conducting unit L1 is one pair, and the number of the nonmagnetic conducting unit L2 is one pair. The pair of magnetic conducting units L1 and the pair of nonmagnetic conducting units L2 are arranged along the diagonal lines of the end surface 421 in a crisscross manner. Besides, the pair of magnetic conducting units L1 preferably has different magnetic poles. One of the magnetic members 20 faces outside with North Pole, and the other one of the magnetic members 20 faces outside with South Pole. Thus, the magnetic conducting unit L1 of the separable attaching cable 100 attracts each other. As shown in FIG. 2A and FIG. 2B, under the condition of the adapting terminal 30 and the conductive wire 12 are made of nonmagnetic material, such as copper, the magnetic member 20 of the magnetic conducting unit L1 will not attract incorrectly the nonmagnetic conducting unit L2. Therefore, this embodiment did not need error-proofing structure design, and two separable attaching cables 100 can attract each other correctly by the above-mentioned different magnetic arrangement. However, the instant disclosure is not limited thereto, the separable attaching cable 100 can have like magnetic poles at the end surface 421, such as both North poles are arranged at one end, and two South Poles are arranged at the other end.

Moreover, the instant disclosure still can have error-proofing design. Two different separable attaching cables 100 could has convex and concave corresponding structure which are formed on the end surface 421 of the attach-conductive adapter 42. Thus, the separable attaching cable 100 can also provide function of error-proofing attachment by the convex and concave corresponding structure, for prevent two cables are connected incorrectly. The convex and concave corresponding structure can be provided in the separable attaching cables 100 with a single magnetic conducting unit L1 for assisting directional orientation.

The above-mentioned adapting terminal provided by this embodiment has advantage that can not only fix the magnetic member 20, but also provide function of electrical connection. The magnetic parts do not occupy additional area on the end surface of cable and space is saved more, so that it can be applied in an audio transmission line of smaller diameter. Please refer to FIG. 1 and FIG. 2, the separable attaching cable 100 of this embodiment can attract each other more stably, such features are fit for portable electronic device. It provides better safety to avoid pulling down and damaging the electronic device. As shown in FIG. 1, when the connecting cable of this embodiment is inattentively pulled and dragged, it only separates the separable attaching cable 100, the plugging section 100*a* and the receiving section 100*b*, and the portable electronic device will not be pulled down.

In the instant disclosure, the separable attaching cable can further has a conductive shielding layer covering on an outer periphery thereof (not shown), a knitting layer covering on the conductive shielding layer (not shown). The knitting layer covers on the conductive shielding layer, which is formed by a plurality of knitting metal wires and elastic fiber yarn (not shown). The fiber yarn can be nylon yarn . . . etc. The fiber yarn can help the cable to endure many times of bending or twisting. The conductive shielding layer and the knitting layer can prevent leakage of shield electromagnetic waves from the inside cords 10, and further, electric and magnetic fields outside the cable are kept from causing interference to signals inside the cords 10.

Figure 5:
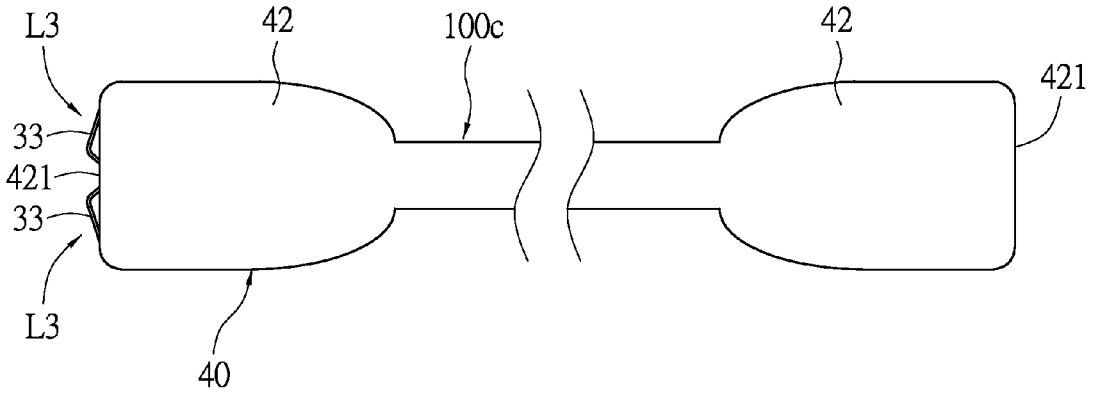
FIG. 5 shows a front view of a separable attaching cable according to second embodiment of the instant disclosure.
Figure 5A:
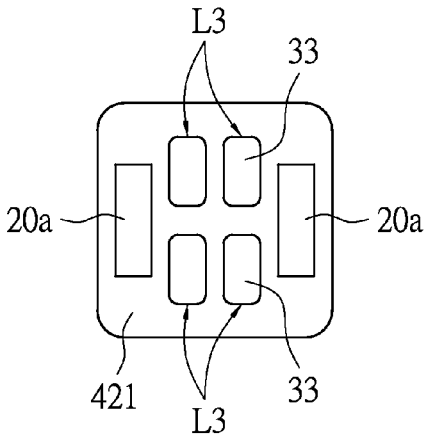
FIG. 5A is a left side view of FIG. 5.
Figure 5B:
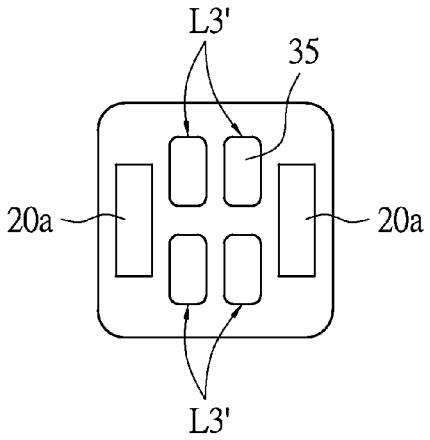
FIG. 5B is a right side view of FIG. 5.

Please refer to FIG. 5, which is a front view of the separable attaching cable according to second embodiment of the instant disclosure. FIG. 5A and FIG. 5B are side views of the cable of FIG. 5. In this embodiment, the attach-conductive adapter 42 of separable attaching cable 100*c* respectively has a pair of magnetic member 20*a* exposed outside the end surface 421. The pair of magnetic members 20*a* are arranged at an outside of the conductive plates 33, 35, and the pair of magnetic members 20*a* have different poles which are oppositely arranged in the attach-conductive adapter 42. In this embodiment, the magnetic member 20*a* can be rectangular-shaped, so that it has larger area with greater attraction force.

Figure 5C:
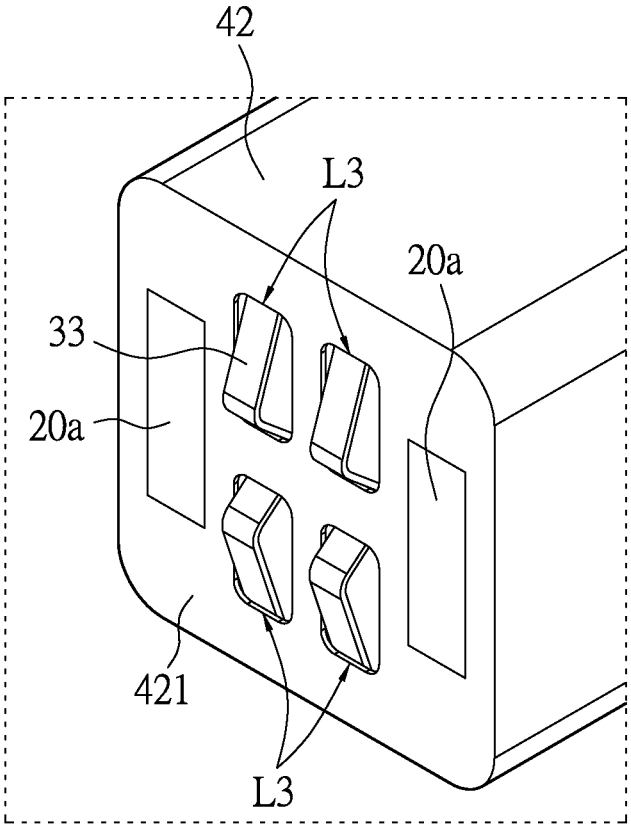
FIG. 5C is a partial perspective view of the separable attaching cable according to second embodiment of the instant disclosure.

Please refer to FIG. 5C, which is a perspective view of FIG. 5A. One end of the separable attaching cable 100*c* has a plurality of conductive plates 33 which has elastic spring-contact protruded outside of the end surface 421. As shown in FIG. 5B and the attach-conductive adapter 42 at right end of FIG. 5, the other end of the cable 100*c* has a plurality of conductive plates 35 which are planar terminals arranged on the end surface 421, such as electroplating contact.

The connecting cable of this embodiment is treated as an example for earphone. As shown in FIG. 5A, there are four nonmagnetic conducting units L3. As shown in FIG. 5B, there are four nonmagnetic conducting units L3'. Each of the nonmagnetic conducting units (L3, L3') of the attach-conductive adapter 42 has four conductive plates 33 which are arranged in a rectangular manner. As shown in FIG. 5A, the four conductive plates 33 include a microphone contact (such as left upper corner), a left sound-track contact (such as left lower corner), a right sound-track contact (such as right upper corner) and a ground contact (such as right lower corner). The left sound-track contact and the right sound-track contact are arranged along a diagonal line. Such arrangement makes the attach-conductive adapters 42 at two ends conveniently to attract each other, and signals will not be connected incorrectly. One may notice that the earphone without microphone function, the microphone contact can be omitted.

Figure 6:
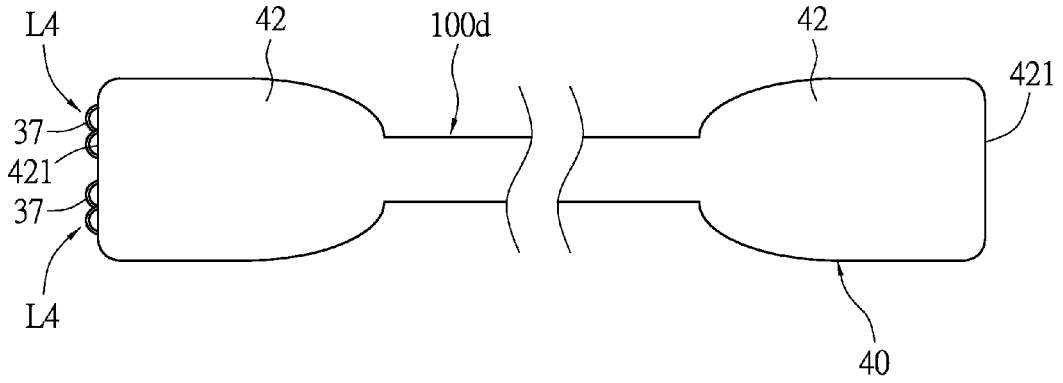
FIG. 6 shows a front view of a separable attaching cable according to third embodiment of the instant disclosure.
Figure 6A:
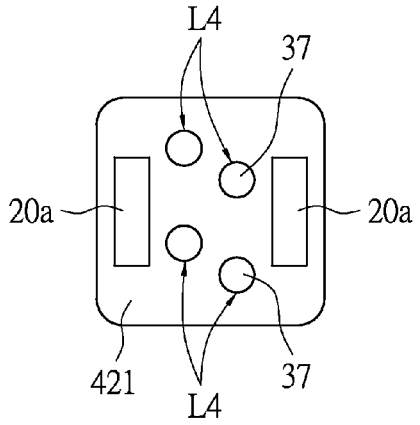
FIG. 6A is a left side view of FIG. 6.
Figure 6B:
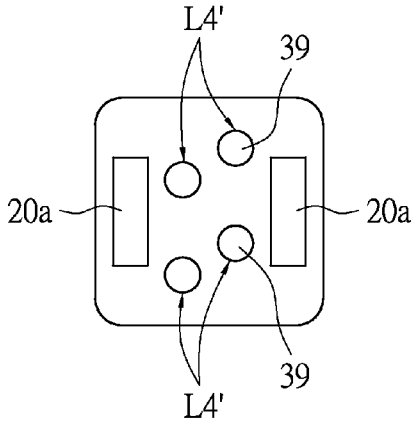
FIG. 6B is a right side view of FIG. 6.

Please refer to FIG. 6, which is a front view of the separable attaching cable of third embodiment according to the instant disclosure. FIG. 6A and FIG. 6B are side views of the cable shown in FIG. 6. In this embodiment, the attach-conductive adapter 42 of the separable attaching cable 100*d* is arranged similar as the above-mentioned embodiment. The attach-conductive adapter 42 has a pair of magnetic members 20*a* exposed outside the end surface 421. The pair of magnetic members 20*a* are arranged at an outside of the conductive plates 37, 39, and the poles of the magnetic members 20*a* are oppositely arranged on the attach-conductive adapter 42. The conductive plates 37, 39 of this embodiment are circular-shaped. A supplementary note is that the magnetic members 20*a* can be exchanged as the foregoing description of mechanical attachment, such as magnet, Velcro attachment, buckle element, or wedged element . . . etc.

Refer to FIGS. 6A and 6B. The conductive plates 37 at one end of the separable attaching cable 100 are circular-shaped, which are elastic spring-contact protruded outside of the end surface 421, as shown in FIG. 6A. The conductive plates 39 at the other end of the separable attaching cable 100*d* are planar-shaped arranged on the end surface 421, as shown in FIG. 6B.

The connecting cable of this embodiment is treated as an example for earphone. As shown in FIG. 6A, there are four nonmagnetic conducting units L4. As shown in FIG. 6B, there are four nonmagnetic conducting units L4'. Each of the nonmagnetic conducting units (L4, L4') of the attach-conductive adapter 42 has four conductive plates 37 which are arranged in a rectangular manner, or rhombus-shaped. As shown in FIG. 6A, the four conductive plates 37 include a microphone contact (such as left upper corner), a left sound-track contact (such as left lower corner), a right sound-track contact (such as right upper corner) and a ground contact (such as right lower corner). The left sound-track contact and the right sound-track contact are arranged along a diagonal line. Such arrangement makes the attach-conductive adapters 42 at two ends conveniently to attract each other, and signals will not be connected incorrectly.

Figure 7:
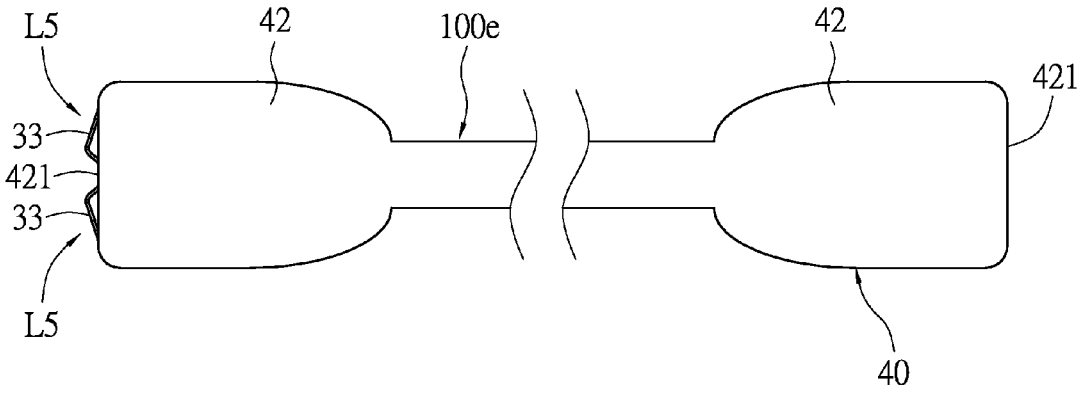
FIG. 7 shows a front view of a separable attaching cable according to fourth embodiment of the instant disclosure.
Figure 7A:
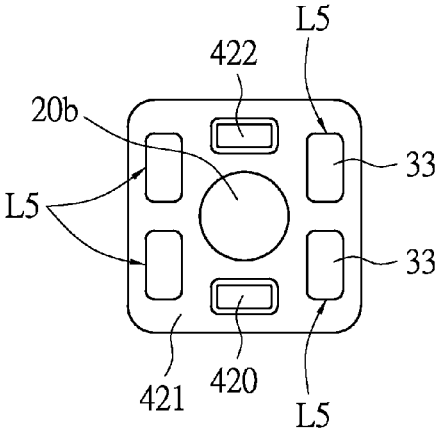
FIG. 7A is a left side view of FIG. 7.
Figure 7B:
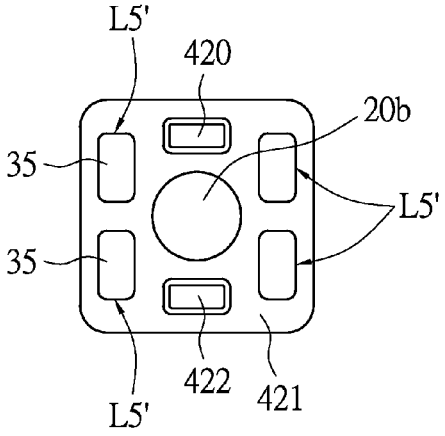
FIG. 7B is a right side view of FIG. 7.

Please refer to FIG. 7, which is a front view of the separable attaching cable of fourth embodiment according to the instant disclosure. FIG. 7A and FIG. 7B are side views of the cable shown in FIG. 7. The attach-conductive adapter 42 of the separable attaching cable 100*e* in this embodiment, there is one magnetic member 20*b* which is exposed outside and arranged at a center of the end surface 421. The conductive plates 33, 35 are arranged at an outside of the magnetic member 20*b*. Each attach-conductive adapter 42 has two concave-convex orientation structures (420, 422). The attach-conductive adapters 42 at two ends of the separable attaching cables 100*e* have opposite magnetic poles. A supplementary note is that the magnetic members 20*b* can be exchanged as the foregoing description of mechanical attachment, such as magnet, fastener (such as Velcro attachment), buckle element, or wedged element . . . etc.

Please refer to FIG. 7A, FIG. 7B. The conductive plates 33 at one end of the separable attaching cable 100*e* are elastic spring-contact protruded outside of the end surface 421. The conductive plates 35 at the other end of the separable attaching cable 100*e* are planar-shaped arranged on the end surface 421. Each attach-conductive adapter 42 has a concave portion 420 and a convex portion 422.

This embodiment can be treated as a connecting cable of earphone arranged similarly as the foregoing embodiments. There are four nonmagnetic conducting units L5 as shown in FIG. 7A, and four nonmagnetic conducting units L5' as shown in FIG. 7B. As illustrated in FIG. 7A, four conductive plates 33 are a microphone contact (such as left upper corner), a left sound-track contact (such as left lower corner), a right sound-track contact (such as right upper corner) and a ground contact (such as right lower corner), respectively. The left sound-track contact and the right sound-track contact are arranged along a diagonal line. Such arrangement makes the attach-conductive adapters 42 at two ends conveniently to attract each other, and signals will not be connected incorrectly.

To sum up, the instant disclosure has beneficial results that, the earphone according to the instant disclosure has many sections which are separably attached each other, so that the length of the connecting cable is adjustable. When the connecting cable are separated, the sections can be stacked without entangling and tying. A convenient collation manner is provided. Besides, the separable attaching manner allows the earphone is separated from the electronic device without pulling down. A safety protective method is provided. Moreover, the magnetic conducting units have both functions of magnetic attraction and electricity transmission, and the magnetic attraction will not occupy additional space with compact design. Therefore, the separable attaching cables 100 of the instant disclosure can be applied as transmission cable with smaller diameter.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An earphone with adjustable-length cable, comprising:

a plugging section, having an attach-conductive adapter at one end thereof, and a plug at the other end thereof;

a receiving section, having an attach-conductive adapter at one end thereof, and an audio-playing unit at the other end thereof; and a connecting cable, connecting the plugging section and the receiving section, the connecting cable including at least one separable attaching cable, each of the two ends of the separable attaching cable having an attach-conductive adapter;

wherein each of the attach-conductive adapters is formed with an end surface, and has at least one attaching element and a plurality of conductive plates exposed outside the end surface;

wherein the attach-conductive adapter of the plugging section, the attach-conductive adapter of the receiving section and the attach-conductive adapter of the connecting cable are attached to each other through the at least one attaching element, and electrically connecting to each other through the conductive plates, thereby signals from the plugging section are transmitted to the receiving section and transferred to sound so as to be played by the audio-playing unit;

wherein each separable attaching cable includes at least one magnetic conducting unit and a protective jacket surrounding the at least one magnetic conducting unit; wherein each magnetic conducting unit has a cord, an adapting terminal, and the attaching element disposed at a front end of the cord, wherein the attaching element is a magnetic member, wherein the cord has a conductive wire and an insulative layer surrounding the conductive wire; the magnetic member has an outer surface and a side surface contiguous to the outer surface; wherein the adapting terminal has a holding part to hold the side surface of the magnetic member, an extending part connected with the holding part, and the conductive plate connected with the holding part; wherein the extending part is fixed to and electrically conducted with the conductive wire, the conductive plate covers the outer surface of the magnetic member.

2. The earphone with adjustable-length cable according to claim 1, wherein the adapting terminal further has a snapping part connected with the conductive plate, the snapping part and the holding part are oppositely arranged at two sides of the conductive plate and around the magnetic member.

3. The earphone with adjustable-length cable according to claim 2, wherein the conductive plate of the adapting terminal is protruded outside the end surface; wherein a length of the holding part is substantially equal to that of a side surface of the magnetic member; wherein the conductive plate and the extending part are arranged oppositely at two sides of the holding part.

4. The earphone with adjustable-length cable according to claim 3, wherein the protective jacket further includes at least one nonmagnetic conducting unit, each nonmagnetic conducting unit includes:

a cord, having a conductive wire, and an insulative layer surrounding the conductive wire; and a non-attaching adapting terminal, having an extending part connected with the conductive wire, and a conductive plate connected with the extending part, and a snapping part connected with the conductive plate, the snapping part and the extending part are oppositely arranged at two sides of the conductive plate, the conductive plate is exposed outside the end surface.

5. The earphone with adjustable-length cable according to claim 4, wherein the quantity of the magnetic conducting unit is one pair, the quantity of the nonmagnetic conducting unit is one pair, wherein the pair of magnetic conducting units and the pair of nonmagnetic conducting units are arranged along the diagonal lines of the end surface in a crisscross manner, the pair of magnetic conducting units preferably has different magnetic poles.

6. The earphone with adjustable-length cable according to claim 1, wherein each attach-conductive adapter of the separable attaching cable has a pair of attaching elements, wherein the attaching element is a magnetic member, the magnetic member is exposed outside of the end surface, and the pair of magnetic members are arranged outside the conductive plates, and the pair of magnetic members has different magnetic poles arranged on the attach-conductive adapter.

7. The earphone with adjustable-length cable according to claim 6, wherein the conductive plates on one end of the separable attaching cable has elastic spring-contact outward protruded outside of the end surface, the conductive plates on the other end of the separable attaching cable are planar and disposed on the end surface.

8. The earphone with adjustable-length cable according to claim 7, wherein the conductive plates of the attach-conductive adapter includes a microphone contact, a left sound-track contact, a right sound-track contact and a ground contact, which are arranged in a rectangular manner, wherein the left sound-track contact and the right sound-track contact are arranged along a diagonal line.

9. The earphone with adjustable-length cable according to claim 1, wherein the quantity of the attaching element of the attach-conductive adapter is one and exposed at a center of the end surface, wherein the conductive plates are arranged around the attaching element, wherein each of the attach-conductive adapters has at least one concave-convex orientation structure, wherein the attaching element is selected from the group of: magnet, fastener, buckle element, and wedged element.

10. An earphone with adjustable-length cable, comprising:

a plugging section, having an attach-conductive adapter at one end thereof, and a plug at the other end thereof;

a receiving section, having an attach-conductive adapter at one end thereof, and an audio-playing unit at the other end thereof; and a connecting cable, connecting the plugging section and the receiving section, the connecting cable including at least one separable attaching cable, each of the two ends of the separable attaching cable having an attach-conductive adapter;

wherein each of the attach-conductive adapters is formed with an end surface, and has at least one attaching element and a plurality of conductive plates exposed outside the end surface;

wherein the attach-conductive adapter of the plugging section, the attach-conductive adapter of the receiving section and the attach-conductive adapter of the connecting cable are attached each other through the at least one attaching element, and electrically connecting each other through the conductive plates, thereby signals from the plugging section are transmitted to the receiving section and transferred to sound so as to be played by the audio-playing unit;

wherein each attach-conductive adapter of the separable attaching cable has a pair of attaching elements, wherein the attaching element is magnetic member, the magnetic member is exposed outside of the end surface, and the pair of magnetic members arranged outside the conductive plates, and the pair of magnetic members has different magnetic poles arranged on the attach-conductive adapter.

11. The earphone with adjustable-length cable according to claim 10, wherein the conductive plates on one end of the separable attaching cable has elastic spring-contact outward protruded outside of the end surface, the conductive plates on the other end of the separable attaching cable are planar and disposed on the end surface.

12. The earphone with adjustable-length cable according to claim 11, wherein the conductive plates of the attach-conductive adapter includes a microphone contact, a left sound-track contact, a right sound-track contact and a ground contact, which are arranged in a rectangular manner, wherein the left sound-track contact and the right sound-track contact are arranged along a diagonal line.

* * * * *